US007703588B2

(12) United States Patent
Chiang

(10) Patent No.: US 7,703,588 B2
(45) Date of Patent: Apr. 27, 2010

(54) WHEEL ASSEMBLY OF LUGGAGE

(75) Inventor: Hsi-Wu Chiang, Taichung (TW)

(73) Assignee: C & C Luggage Manufacturing Co., Ltd., Taichung (TW)

( * ) Notice: Subject to any disclaimer, the term of this patent is extended or adjusted under 35 U.S.C. 154(b) by 211 days.

(21) Appl. No.: 12/081,804

(22) Filed: Apr. 22, 2008

(65) Prior Publication Data

US 2009/0242343 A1 Oct. 1, 2009

(51) Int. Cl.
*B60B 33/00* (2006.01)

(52) U.S. Cl. ..... 190/18 A; 188/1.12; 16/35 R

(58) Field of Classification Search ..... 190/18 A; 16/18 R, 45–48, 35 R, 29; 188/1.12
See application file for complete search history.

(56) References Cited

U.S. PATENT DOCUMENTS 4,143,442 A * 3/1979 Harlang ..... 16/35 R
4,479,566 A * 10/1984 Ishii ..... 188/1.12
5,014,391 A * 5/1991 Schulte ..... 16/35 R
5,133,106 A * 7/1992 Milbredt et al. ..... 16/35 R
5,368,133 A * 11/1994 Yang ..... 188/1.12
5,415,252 A * 5/1995 Estkowski ..... 188/1.12
6,360,851 B1 * 3/2002 Yang ..... 188/1.12
6,382,364 B1 * 5/2002 Chuang ..... 188/1.12
6,532,624 B1 * 3/2003 Yang ..... 16/35 R
6,619,438 B1 * 9/2003 Yang ..... 188/1.12
2007/0215414 A1 * 9/2007 Chiang ..... 188/1.12
2007/0289098 A1 * 12/2007 Tsai ..... 16/35 R

* cited by examiner

*Primary Examiner*—Tri M Mai
(74) *Attorney, Agent, or Firm*—Bacon & Thomas, PLLC

(57) ABSTRACT

The present invention relates a wheel assembly of a luggage, which has two wheels side by side and the control assembly. The control assembly has a switch device for manipulation to brake the wheels. The control assembly has a fixed position to be manipulative by user easily. The wheels have small widths that makes the luggage may run on a carpet without having to draw the luggage with great strength.

10 Claims, 8 Drawing Sheets

WHEEL ASSEMBLY OF LUGGAGE

BACKGROUND OF THE INVENTION

1. Field of the Invention

The present invention relates generally to a luggage and, more particularly, to a wheel assembly of a luggage.

2. Description of the Related Art

For a modern design of a luggage, it concerns a fancy look and strong structure, furthermore, a convenient operation is an important issue. In drawing the luggage, wheels on a bottom of the luggage should be free for rolling, but not every roads that the luggage may run smoothly thereon. For example, the luggage may run freely on a rock flood of, such as, airport or hotel. But it is a hard work when user draws the luggage across a carpet.

In addition, the conventional luggage doesn't have any brake function that the luggage may be moved unexpectedly. We found some luggages, have brakes, but it is not convenient to operate it. As shown in FIG. 1, such luggage is provided with a control device 2 to be manipulated for braking the wheel 1. The control device 2 turns along with the wheel 1 that for some angles, such as the control device 2 is turned to under the case, user is hard to operate it.

SUMMARY OF THE INVENTION

The primary objective of the present invention is to provide a wheel assembly of a luggage, which may run on almost every kind of roads.

The secondary objective of the present invention is to provide a wheel assembly of a luggage, which has brake function, and is easy to operate it.

To achieve the objective of the present invention, a wheel assembly of a luggage, which is mounted on an object, includes a wheel base, which is pivoted on the object along a vertical direction, having a through bore along the vertical direction and a transverse axial bore through opposite sides of the wheel base and deviating the vertical direction; a left wheel, which is pivoted on the wheel base, having a concave portion on a side, in which an inner annular wall having a plurality of slots is formed; a right wheel, which is pivoted on the wheel base beside the left wheel, having a concave portion, in which an inner annular wall having a plurality of slots is formed, on a side facing the side of the left wheel having the concave portion; an axle inserted through the axial bore of the wheel base and connecting the left wheel and the right wheel respectively; and a control assembly, which includes a switch device pivotally arranged above the wheel base, an axial shaft inserted through the through bore of the wheel base and moved by the switch device for a movement along the vertical direction, and a brake device having an end connected to a bottom end of the axial shaft and an opposite end with a transverse stop piece having opposite ends engaged with the slots of the left wheel and the right wheel when the axial shaft is moved upwards.

DETAILED DESCRIPTION OF THE INVENTION

Figure 1:
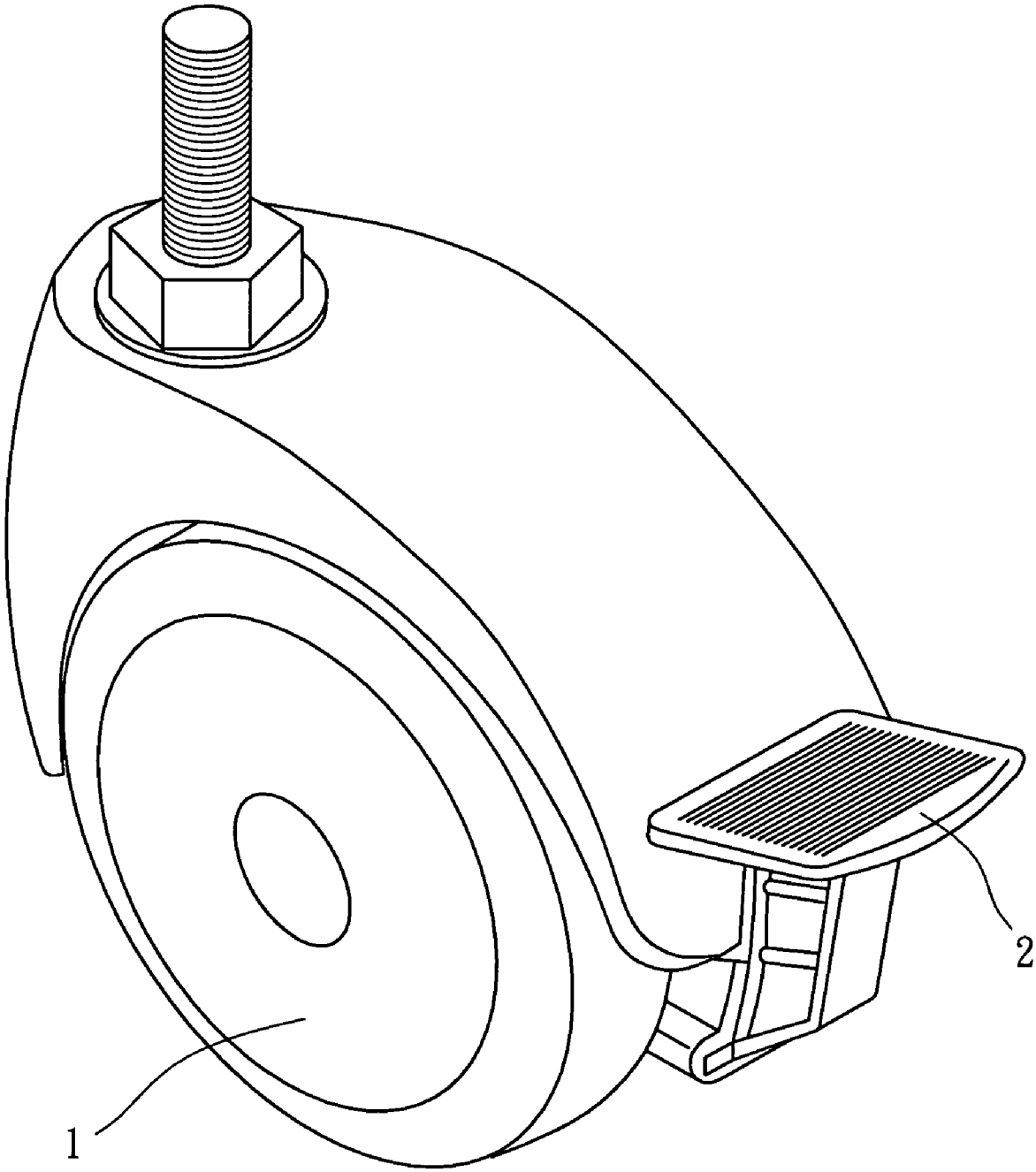
FIG. 1 PRIOR ART
FIG. 1 is a perspective view of the conventional wheel assembly of the luggage with brake function.
Figure 3:
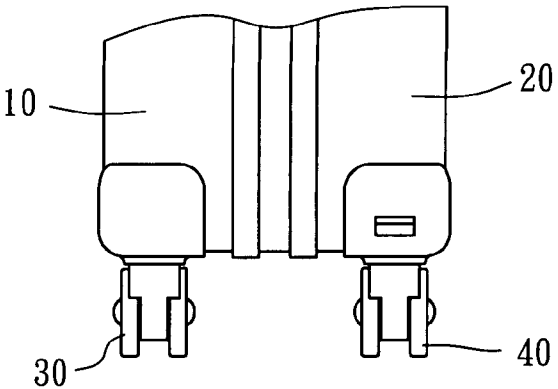
FIG. 2 to FIG. 4 are various views of the wheel assembly of a preferred embodiment of the present invention mounted on the luggage.
Figure 2:
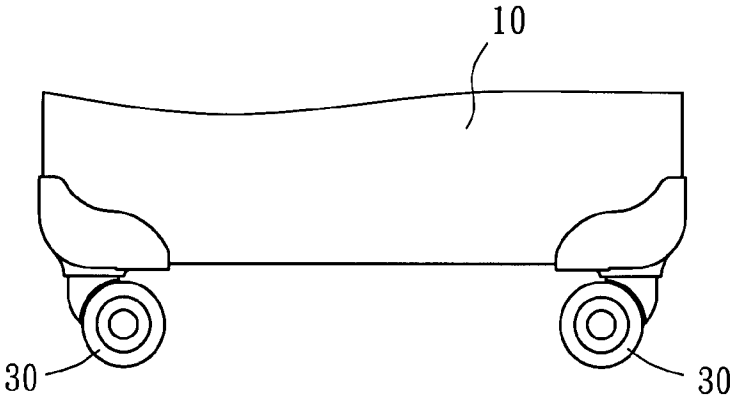
Figure 4:
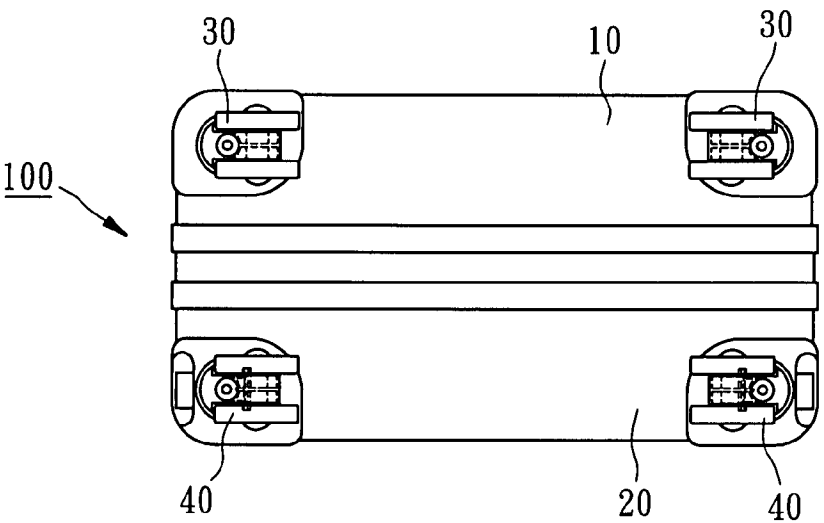

FIGS. 2-4 show a luggage 100 including two case pieces 10, 20 and four wheel assemblies, two of which 30 are mounted on a bottom of the case piece 10, and the other two of which 40 are mounted on a bottom of the case piece 20. The wheel assemblies 40 are equipped with brakes, and the other two are not. The following description is about the wheel assembly 40 with brake.

As shown in FIG. 5, FIG. 5A, FIG. 5B, FIG. 6, and FIG. 7, the wheel assembly 40 includes a seat member 42, a pivot base 44, a wheel base 46, a ball disk 47, a shaft sleeve 48, a pad 49, a left wheel 50, a right wheel 52, an axle 54, a control assembly 56, and an auxiliary positioning assembly 64.

The seat member 42, which is fixed at a corner of the bottom of the case piece 20, has a bottom bore 421 and a lateral opening 422.

The pivot base 44, which is received in the seat member 42, has a round bore 441 aligned to the bottom bore 421, and two lateral plates 442, each of which has a positioning bore 443.

The wheel base 46 has a vertical through bore 461. The shaft 44 is inserted into the through bore 461 of the wheel base 46, the ball disk 47, the bottom bore 421 of the seat base 42, and the round bore 441 of the pivot base 44 in sequence. And then, the shaft 44 is inserted into the pad 49 to pivot the wheel base 46 on a bottom of the seat member 42. The wheel 46 further has a transverse axial bore 462 and a lateral through bore 463 communicated with the through bore 461.

Figure 5:
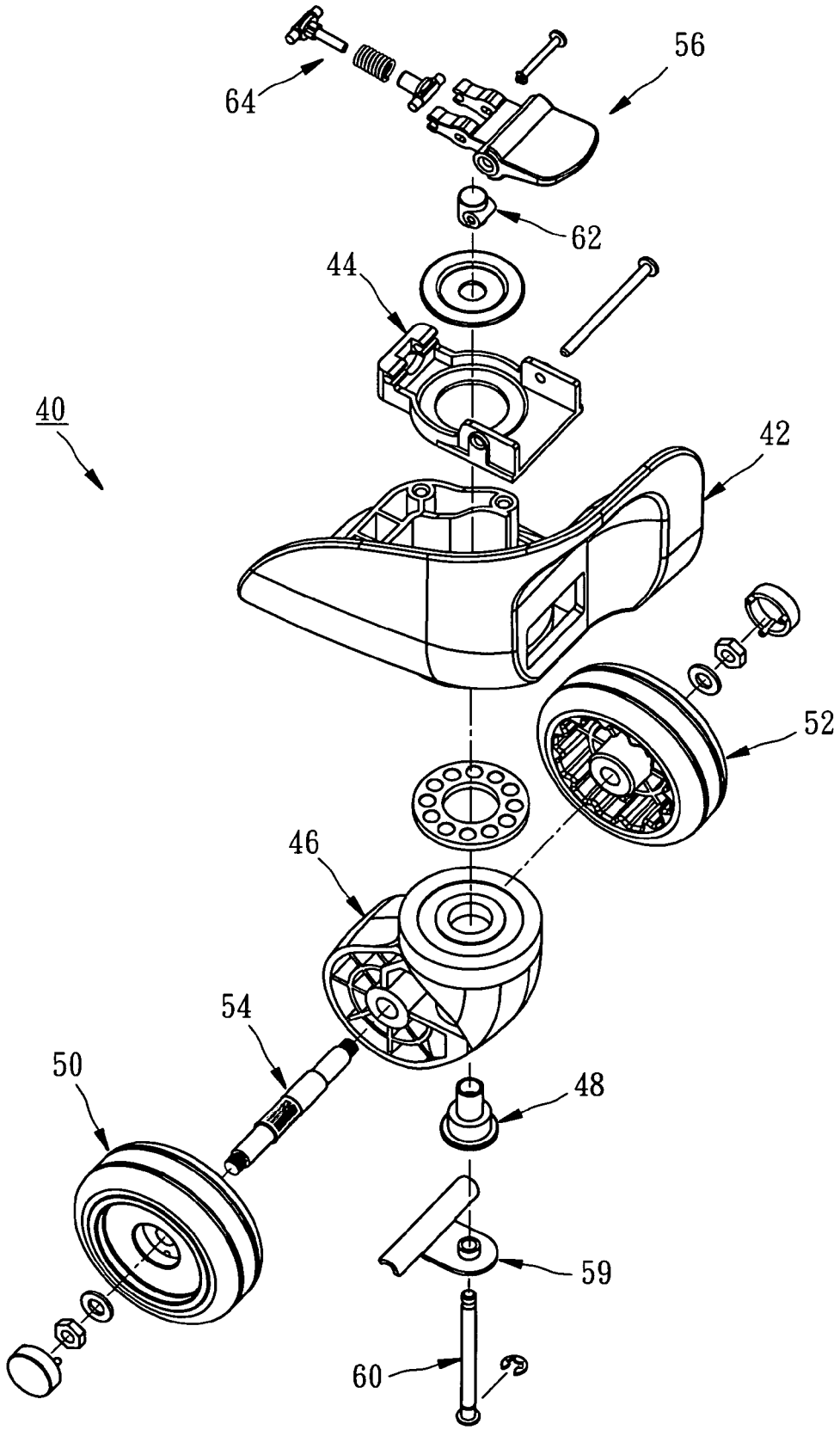
FIG. 5, FIG. 5A, and FIG. 5B are exploded views of the preferred embodiment of the present invention.
Figure 5A:
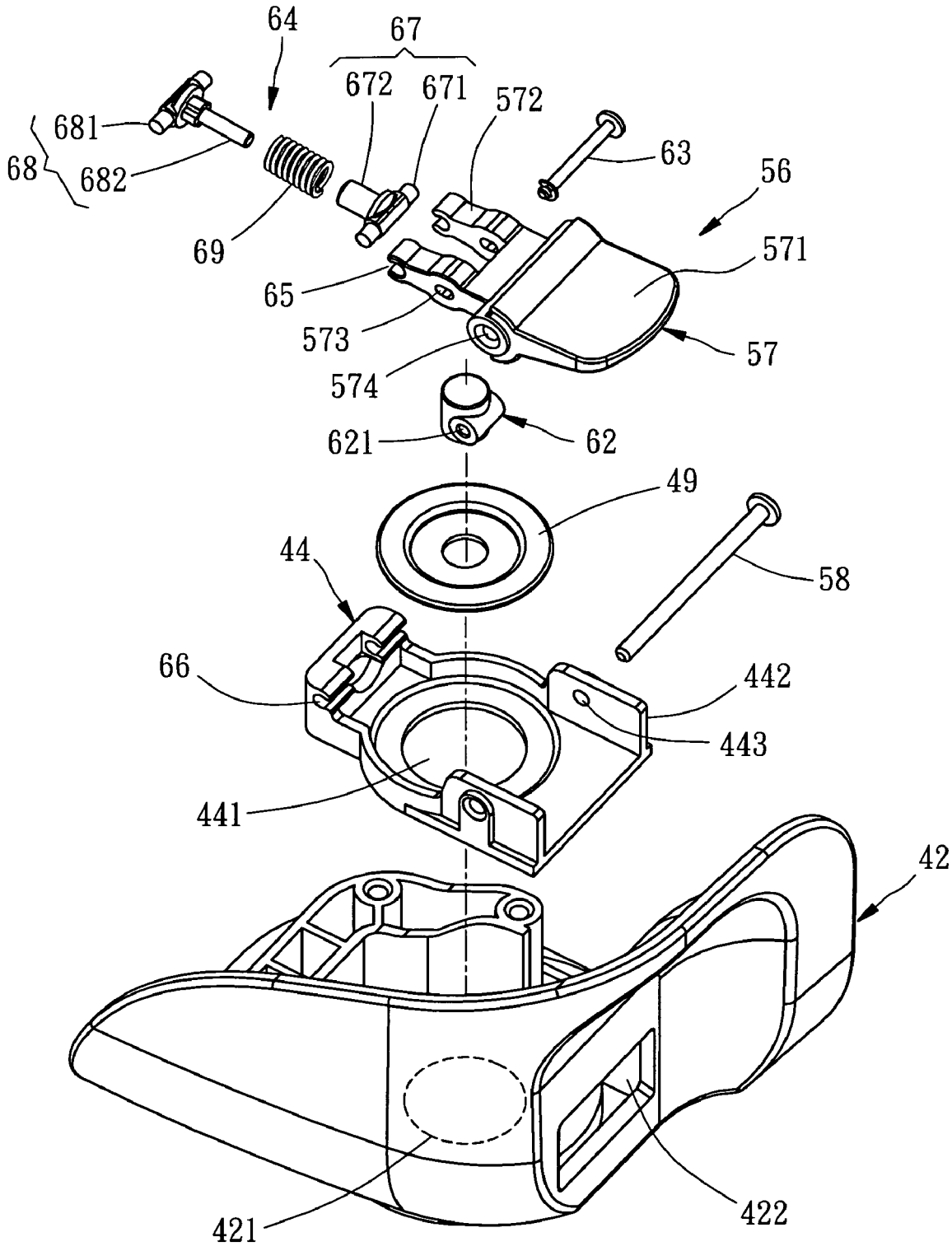
Figure 5B:
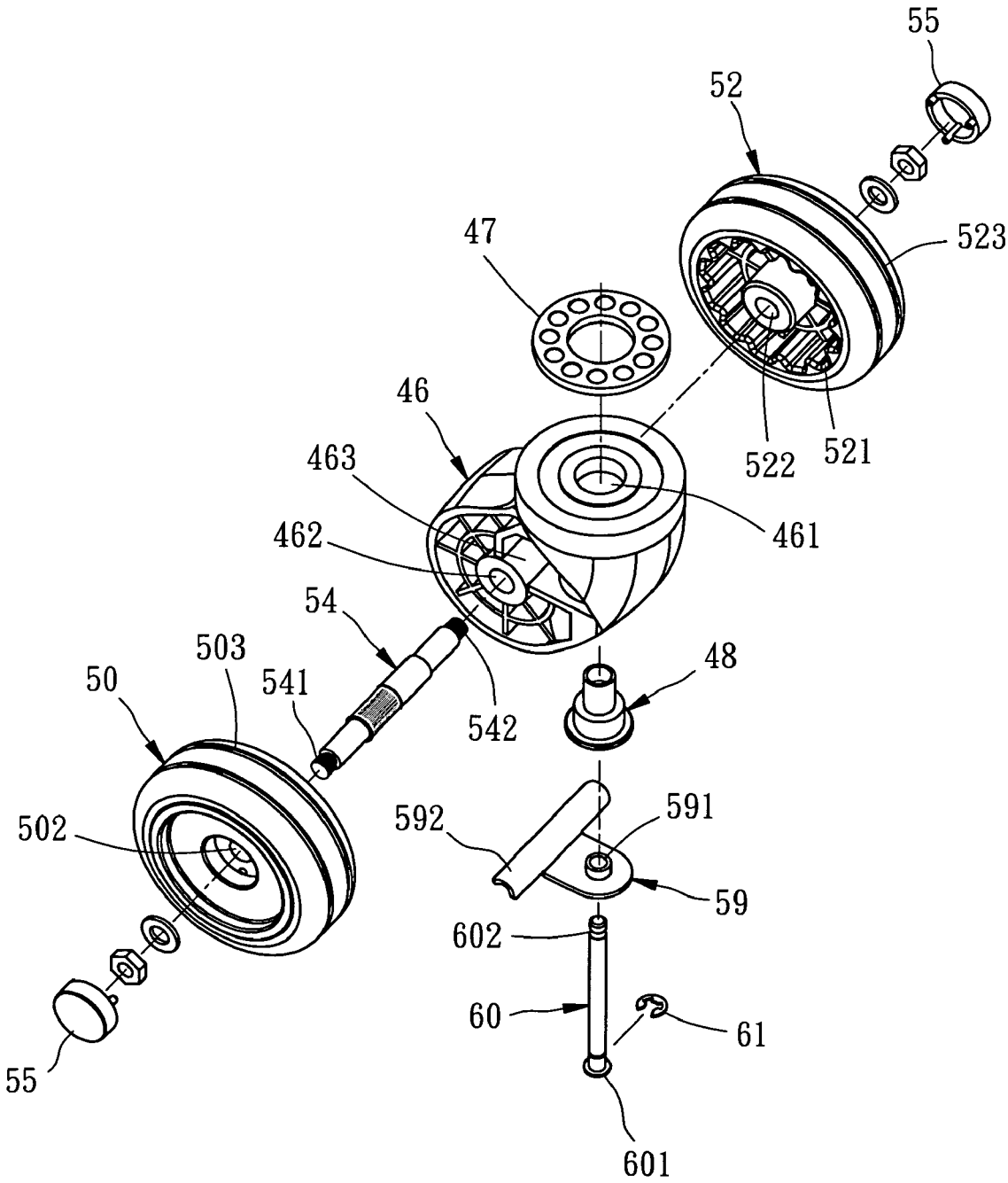

The left wheel 50 is as same as the right wheel 52. The left and right wheels 50, 52 are pivoted side by side on the wheel base 46. The neighboring sides of the wheels 50, 52 have a concave portion, in which an inner annular wall having a plurality of slots is formed. The slots 521 are shown in FIG. 5 for example. The wheels 50, 52 have a threaded bore 502, 522 at a center respectively and trenches 503, 523 on a circumference respectively.

The axle 54 is inserted into the axial bore 462 of the wheel base 46, and has two threaded sections 541, 542 on opposite ends to be screwed with the threaded bores 502, 522 respectively that the wheels 50, 52 are pivoted on the wheel base 46. Two lids 55 are provided on the wheels 50, 52 to shield the opposite ends of the axle 54.

The control assembly 56 has a switch device 57, a pin 58, a brake device 59, an axial shaft 60, a top lid 62, and a transverse shaft 63.

The switch device 57 is provided between the lateral plates 442 of the pivot base 44. The pin 58 is inserted into a pivot bore 574 of the switch device 57. Opposite ends of the pin 58 are inserted into the positioning bores 443 of the lateral plates 442. The switch device 57 has an operative board 571 through the lateral opening 422 of the seat member 42 and two parallel arms 572. The operative board 571 is manipulative for movement up and down, and each of the arms 572 has a through bore 573.

The brake device 59 has a through bore 591 at an end thereof, and a convex transverse stop piece 592 at the other end.

Figure 6:
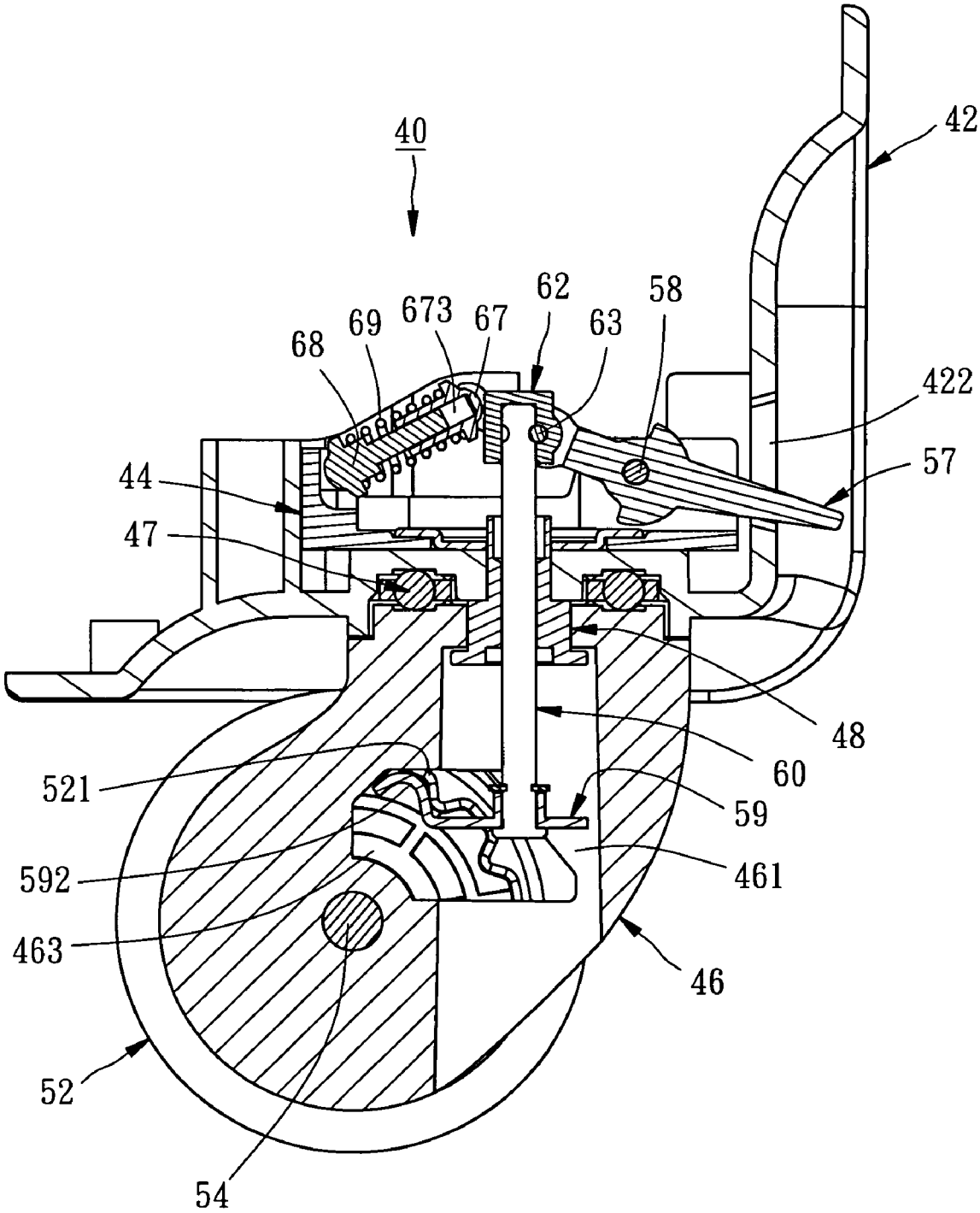
FIG. 6 is a sectional view of the preferred embodiment of the present invention, showing the wheel braked.
Figure 7:
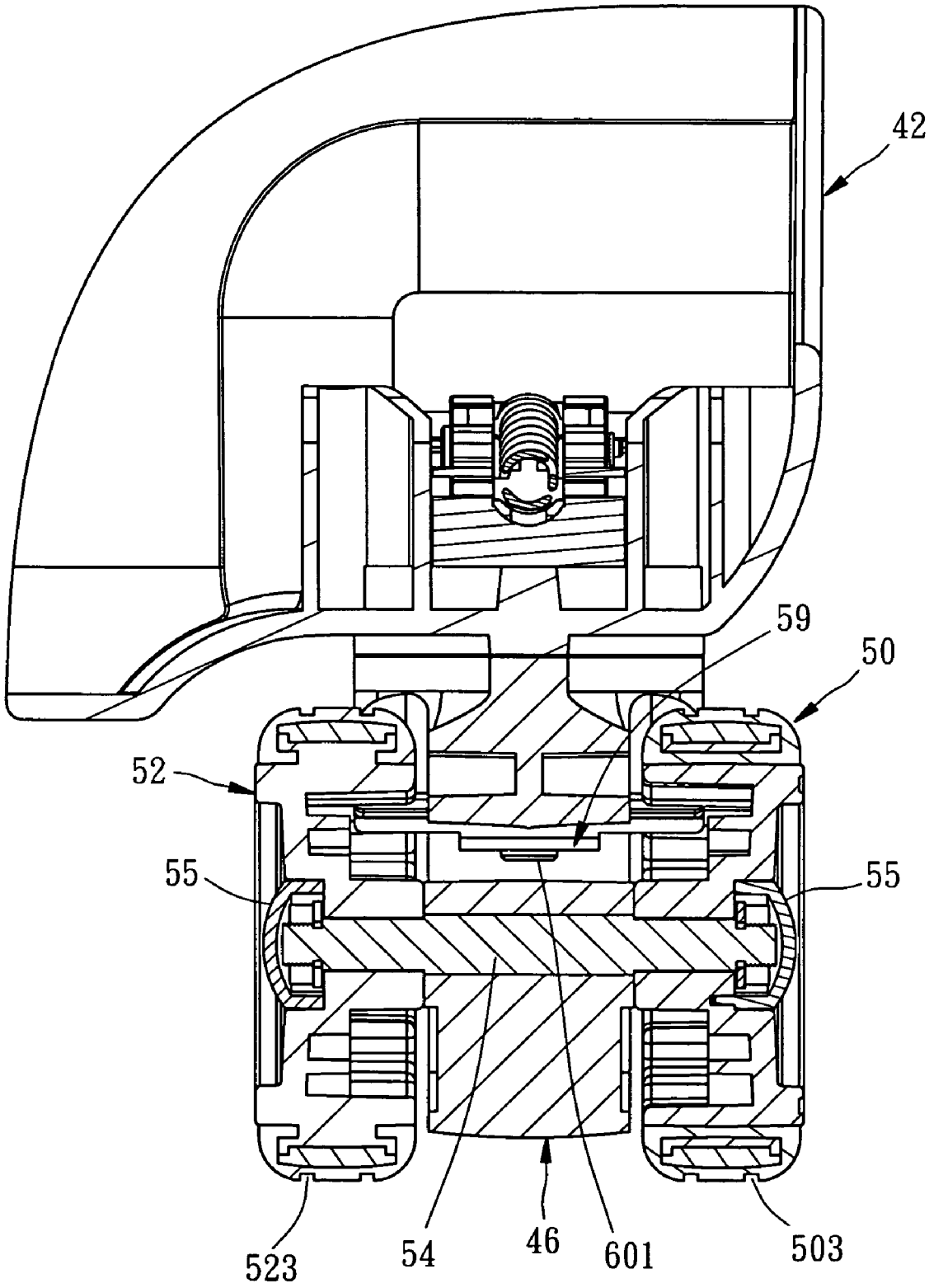
FIG. 7 is another sectional view of the preferred embodiment of the present invention, showing the wheel being braked.

The axial shaft 60 is inserted through the through bore 591 of the brake device 59 and the shaft sleeve 48. The axial shaft 60 has a head portion 601 at a bottom thereof, and a C ring 61 is fitted to the axial shaft adjacent to the head portion 601 to prevent the brake device 59 from loosing. As shown in FIG. 6, after assembling, the transverse stop piece 592 of the brake device 59 is between the axial bore 462 and the through bore 461, and the axial shaft 60 has an annular slot 602 adjacent to the top end.

The top lid 62, which is provided on the top end of the axial shaft 60, has a transverse through bore 621 aligned to the annular slot 602. The transverse shaft 63 passes through the through bores 573 of the arms 572 and through between the transverse through bore 621 of the top lid 62 and the annular slot 602 of the axial shaft 60.

Figure 8:
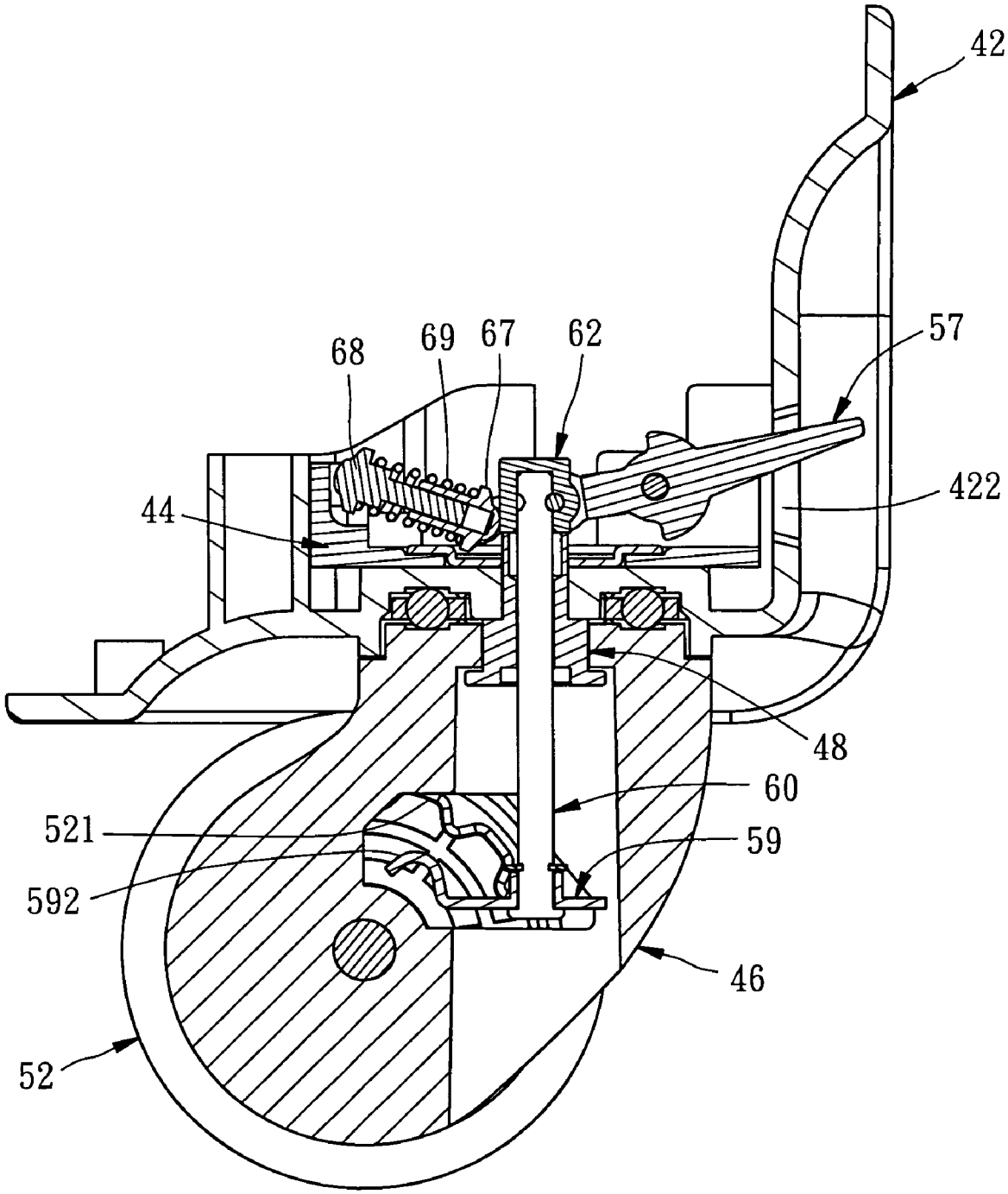
FIG. 8 is a sectional view of the preferred embodiment of the present invention, showing the wheel being unbraked.

With the elements as described above, one may switch the switch device 57 up and down to move the axial shaft 60 along a vertical axial direction of the shaft sleeve 48. As shown in FIG. 6, the upward-moved axial shaft 60 will move the brake device 59 to engage opposite ends of the lateral stop piece 592 with the slots 521 of the left and right wheels 50, 52 for brake. On the contrary, when one switches the control shaft downward, it may disengage the lateral stop piece 592 of the brake device 59 with the slots of the wheels, as shown in FIG. 8. As a result, the left and right wheels 50, 52 may run freely.

The auxiliary positioning assembly 64 is provided for restriction of the axial shaft 64 at an up position and a down position when it is moved by the switch device 57. The auxiliary positioning assembly 64 includes:

a first hole 65 on a free end of each arm 572;

a second hole 66 on the pivot base 44;

a first T-shaped member 67 having a transverse shaft 671 inserted into the first hole 65, and a post 672 having an axial bore 673;

a second T-shaped member 68 having a transverse shaft 681 inserted into the second hole 66, and a post 682 inserted into the axial bore 673 of the post 672 of the first T-shaped member 67; and a spring 69 fitted to the posts 672, 682 of the first and second T-shaped members 67, 68.

The combination of the first and second T-shaped members 67, 68 restricts the spring 69 compressing along a linear direction. The elasticity of the spring 69 may keep the axial shaft 60 at the up or down positions that help the operation of brake.

Above is the description of the elements of the present invention, and the functions of the present invention are listed hereunder:

1. The wheel assembly 40 of the present invention includes two wheels, the left wheel 50 and the right wheel 52. The widths of the wheels is smaller, and the wheels has the trenches 503, 523 that the luggage equipped with the wheel assemblies of the present invention still may be drawn on a carpet without having to exert a great power.

2. The switch device 57 is for manipulation of brake. It has a fixed position and will not turn along with the wheel base 46 that is convenient to operate it.

3. The transverse stop piece 592 of the brake device 59 is between the axial bore 462 and the through bore 461, and is convex. In the braking condition of FIG. 6, when the luggage 100 is impacted by an unexpected force and forces the left wheel 50 and the right wheel 52 turning, it will make the brake device 59 deformed and engaging the transverse stop piece 592 with the slot immediately to brake the luggage.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A wheel assembly of a luggage, which is mounted on an object, comprising:

a wheel base, which is pivoted on the object along a vertical direction, having a through bore along the vertical direction and a transverse axial bore through opposite sides of the wheel base and deviating the vertical direction;

a left wheel, which is pivoted on the wheel base, having a concave portion on a side, in which an inner annular wall having a plurality of slots is formed;

a right wheel, which is pivoted on the wheel base beside the left wheel, having a concave portion, in which an inner annular wall having a plurality of slots is formed, on a side facing the side of the left wheel having the concave portion;

an axle inserted through the axial bore of the wheel base and connecting the left wheel and the right wheel respectively; and a control assembly, which includes a switch device pivotally arranged above the wheel base, an axial shaft inserted through the through bore of the wheel base and moved by the switch device for a movement along the vertical direction, and a brake device having an end connected to a bottom end of the axial shaft and an opposite end with a transverse stop piece having opposite ends engaged with the slots of the left wheel and the right wheel when the axial shaft is moved upwards.

2. The wheel assembly as claimed in claim 1, further comprising a pivot base fixed on the object, which has a round bore to receive the axial shaft of the control assembly and two lateral plates, each of which has a positioning bore to receive a pin which pass through the switch device therein, wherein the control assembly further includes a top lid, which has a transverse through bore communicated with an annular slot of the axial shaft, provided on a top of the axial shaft, a transverse shaft parallel to the pin and received between the transverse through bore of the top lid and the annular slot of the axial shaft.

3. The wheel assembly as claimed in claim 2, wherein the wheel base further includes a lateral through bore communicated with the through bore, and the opposite ends of the transverse stop piece of the control assembly pass through the lateral through bore and extend to the concave portions of the left wheel and the right wheel.

4. The wheel assembly as claimed in claim 3, wherein the transverse stop piece of the control assembly is between the axial bore and the through bore, and is convex.

5. The wheel assembly as claimed in claim 2, wherein the switch device has an operative board and two parallel arms on opposite ends respectively, wherein a free end of the operative board extends out of the object, and each of the arms has a through bore to receive the transverse shaft, and the wheel is provided with an auxiliary positioning assembly, which restricts the axial shaft moved by the switch device at an up position and a down position, including:

a first hole on a free end of each arm;

a second hole on the pivot base;

a first T-shaped member having a transverse shaft inserted into the first hole;

a second T-shaped member having a transverse shaft inserted into the second hole; and a spring urging the first T-shaped member and second T-shaped member.

6. The wheel assembly as claimed in claim 5, wherein the first T-shaped member further includes a post having an axial bore, and the second T-shaped member further includes a post inserted into the axial bore of the post of the first T-shaped member, and the spring is fitted to the posts respectively.

7. The wheel assembly as claimed in claim 1, further comprising a ball disk between the wheel base and the object.

8. The wheel assembly as claimed in claim 1, further comprising a shaft sleeve inserted into the through bore of the wheel base and inserted through by the axial shaft to guide the axial shaft moving along the vertical direction smoothly.

9. The wheel assembly as claimed in claim 1, wherein the axle has two threaded sections at opposite ends to be screwed into threaded bore of the left wheel and the right wheel respectively, further comprising two lids provided on the left wheel and the right wheel respectively to shield the opposite ends of the axle.

10. The wheel assembly as claimed in claim 1, wherein the left wheel and the right wheel have at least a trench respectively.

* * * * *